US005111631A

United States Patent [19]

Flood et al.

[11] Patent Number: 5,111,631

[45] Date of Patent: May 12, 1992

[54] MODULAR DISPLAY CONSTRUCTION SYSTEM

[76] Inventors: Ronald Flood, 5 Forsyth Road, Toronto, Ontario, Canada, M4S 2P8; Kenneth Young, 45 Roxborough Street West, Toronto, Ontario, Canada, M4R 1T9

[21] Appl. No.: 167,997

[22] Filed: Mar. 14, 1988

[51] Int. Cl.[5] ..... E04H 12/18

[52] U.S. Cl. ..... 52/646; 52/648; 52/DIG. 10

[58] Field of Search ..... 52/DIG. 10, 648, 646, 52/645, 18

[56] References Cited

U.S. PATENT DOCUMENTS

| | | | |
|---|---|---|---|
| Re. 15,133 | 6/1921 | Ballinger et al. . | |
| 856,838 | 6/1907 | Bell | 52/DIG. 10 |
| 2,380,600 | 7/1945 | Loewenstein | 108/1 |
| 2,604,670 | 7/1952 | Horowitz et al. | 20/1 |
| 3,062,340 | 11/1962 | Hunnebeck | 52/646 |
| 3,305,997 | 2/1967 | Baumann | 52/645 |
| 3,581,448 | 6/1971 | Roux | 52/28 |
| 3,591,794 | 7/1971 | Dall et al. | 240/9 |
| 3,736,706 | 6/1973 | Stephenson | 52/28 |
| 3,738,023 | 6/1973 | Sajkovic | 52/DIG. 10 |
| 3,830,031 | 8/1974 | Soisson | 52/645 |
| 4,178,736 | 12/1979 | Salas | 52/648 |
| 4,207,715 | 6/1980 | Kitrick | 52/DIG. 10 |
| 4,250,668 | 2/1981 | Harrison, Jr. | 52/39 |
| 4,359,842 | 11/1982 | Hooker | 52/18 |
| 4,471,596 | 9/1984 | Deaton et al. | 52/668 |
| 4,637,193 | 1/1987 | Lange | 52/648 |
| 4,694,596 | 9/1987 | Fast | 40/622 |

FOREIGN PATENT DOCUMENTS

| | | | |
|---|---|---|---|
| 2815268 | 9/1979 | Fed. Rep. of Germany | 52/18 |
| 1000225 | 8/1965 | United Kingdom | 52/DIG. 10 |
| 2047452 | 11/1980 | United Kingdom | 40/622 |

*Primary Examiner*—Henry E. Raduazo

[57] ABSTRACT

A temporary display booth is constructed from a kit of parts. The kit includes a number of elongate V-shaped components of substantially identical shape and size. Each component has a steel base rod, a pair of perforated metal panels of generally trapezoidal shape extending away from the base rod, and a pair of peripheral edge rods attached to the panels at peripheral edges distant from the base rod. Opposing ends of the three rods are formed with T-shaped connectors which cooperate with disk-shaped connectors formed with radially-directed slots to releasably join the panels at predetermined angles. Temporary ceilings, walls and the like of varying shape and size can be conveniently assembled. Additional components of generally planar, trapezoidal shape also carrying T-shaped connectors are used to complete end surfaces of such structures.

23 Claims, 7 Drawing Sheets

MODULAR DISPLAY CONSTRUCTION SYSTEM

FIELD OF THE INVENTION

The invention relates to components and kits for erecting temporary ceilings, walls and the like, and has specific, though not exclusive, application to the construction of temporary displays.

DESCRIPTION OF THE PRIOR ART

It is now quite common at trade shows and fairs to divide the interior region of a large hall into a number of individual booths or displays where the products and services of different exhibitors can be displayed. The displays have sometimes been custom-designed to display a particular product or to accommodate the space provided at a particular trade show. Modular displays which can be disassembled are now quite common and permit re-use at different installations.

A display structure which has become quite common for such purposes is commonly referred to as a "space frame". The space frame consists essentially of a number of rods of equal length which are releasably joined to one another at angles to define a desired structure. Once assembled, panelling or other display materials can be mounted over the space frame to provide a more aesthetically pleasing appearance. Once a particular trade show is complete, the space frame can be disassembled, conveniently shipped to a new location, and thereafter assembled to define perhaps a different display structure.

Although such space frames permit considerable flexibility in the design of a display and permit re-use, they have a number of shortcomings. In particular, considerable time and labour is required to assemble a display from the various rods. If a display of significant complexity is to be produced, considerable thought must be given to how the various rods are to be assembled to ultimately produce a desired structure. Errors at any stage of assembly may require considerable disassembly and correction. Accordingly, experienced staff is required to produce space frame structures.

It would be desirable to provide components for assembly of a display structure which can be used to assemble temporary walls and ceiling in a variety of shapes and size, which lend themselves to faster assembly and disassembly that prior space frame components and which lend themselves to use by less experienced workmen.

BRIEF SUMMARY OF THE INVENTION

In one aspect, the invention provides a component adapted to be joined with substantially identical components to form a knock-down cellular structure such as a ceiling, wall or the like. The component comprises an elongate base portion having an axis and a pair of opposing base vertices spaced-apart along the axis. First and second side portions are rigidly fixed to and extend away from the base portion, the first side portion defining a first pair of opposing spaced-apart edge vertices and the second side portion defining a second pair of opposing spaced-apart edge vertices. The first pair of edge vertices define with the base vertices a first set of vertices in a trapezoidal vertex relationship, and the second pair of edge vertices define with the base vertices a second set of vertices in a trapezoidal vertex relationship substantially identical to the trapezoidal vertex relationship of the first set. The side portions together have a generally V-shaped cross-section with a predetermined fixed angle between general planes of the side portions, when viewed along the axis of the base portion.

Each vertex of the component comprises a connector portion for use in releasably securing the vertex of the component to a proximate vertex of a substantially identical component. The vertices of each set are so spaced relative to one another and the fixed angle are so selected that the base vertex and an adjacent edge vertex of the component are substantially parallel to the base vertex and an adjacent edge vertex of a substantially identical component when the component and the substantially identical component are oriented with their respective general planes substantially perpendicular. Accordingly, the vertices of such components can be brought together to define cells and to define proper corner formations and permit releasable joining of proximate vertices in a resulting cellular structure.

For purposes of the present disclosure and appended claims, the following terms should be understood as having the following meanings. A "knock-down cellular structure" should be understood as a structure comprising cells and formed of components which can be disassembled and reconfigured to define a variety of different structures. "Trapezoidal vertex relationship" should be understood as indicating substantially the relative spacing and orientation of the vertices of a hypothetical trapezoid having a first base, a second shorter base substantially parallel to the first base, and two sides of equal length and inclined relative to the one another. One trapezoidal vertex relationship is "substantially identical" to another trapezoidal vertex relationship when corresponding sides of their respective hypothetical trapezoids are substantially of equal length. The term "adjacent edge vertex" as used in connection with a base vertex is intended to indicate the edge vertex which is effectively connected to the base vertex by a single side of the associated hypothetical trapezoid. A base vertex and adjacent edge vertex of one component are "substantially parallel" to a base vertex and adjacent edge vertex of another component if an axis through the base and adjacent edge vertex of the one component is substantially parallel to an axis through the base and adjacent edge vertex of the other component. The term "general plane" as used in respect of a generally V-shaped component is intended to denote a plane containing the axis of the base portion associated with the component and substantially bisecting the fixed angle between the pair of side portions of the component.

In another aspect, the invention provides a kit for use in constructing a cellular structure such as a ceilings, walls or the like, particularly, though not exclusively, suitable for the construction of temporary displays. The kit which comprises a multiplicity of V-shaped components of the type described immediately above and a multiplicity of connection means for joining the components. The connection means preferably form releasable connections such that a knock-down structure is provided which can be readily disassembled and transported. The versatility and ease of use of such a kit in the construction of cellular display structures will be more apparent from a description of preferred embodiments of the invention below.

In a still further aspect, the invention provides planar components useful in defining ends surfaces of a cellular structure formed from the V-shaped components described above, but which can themselves be used to erect knock-down cellular structures such as temporary ceilings, walls or the like. The component has a generally trapezoidal peripheral shape with four vertices in trapezoidal vertex relationship. Connection means are associated with each vertex for use in releasably connecting the vertex to a proximate vertex of a similar component when the component and the similar component are oriented in a predetermined relationship relative to one another. The connector means preferably comprise connector portions so oriented relative to the general plane of each component that appropriate complementary connectors constrain assembly in predetermined relative orientations.

In a further aspect, the invention provides a cellular structure such as a ceiling, wall or the like, formed at least in part of a multiplicity of substantially identical V-shaped components, as described above. Connection means join the components to define a multiplicity of cells, the components being oriented relative to one another such each cell has a first inclined wall defined by one of the side portions of a first V-shaped component and a second inclined wall defined by one of the side portions of second V-shaped components. The other side portion of the first V-shaped component defines an inclined wall associated with a first adjoining cell; the other side portion of the second V-shaped component defines an inclined wall associated with a second adjoining cell. The sharing of the V-shaped components between cells leads to a robust structure.

Other aspects of the present invention will be apparent from the description of such preferred embodiments and are more specifically identified in the appended claims.

DESCRIPTION OF THE DRAWINGS

The invention will be better understood with reference to drawings in which:

FIG. 1 is a perspective view of a component for construction of modular walls, ceilings and the like;

FIG. 2 is a perspective view of a component for completing end surfaces of such modular walls, ceilings and the like;

DESCRIPTION OF PREFERRED EMBODIMENTS

Figures 1, 2:
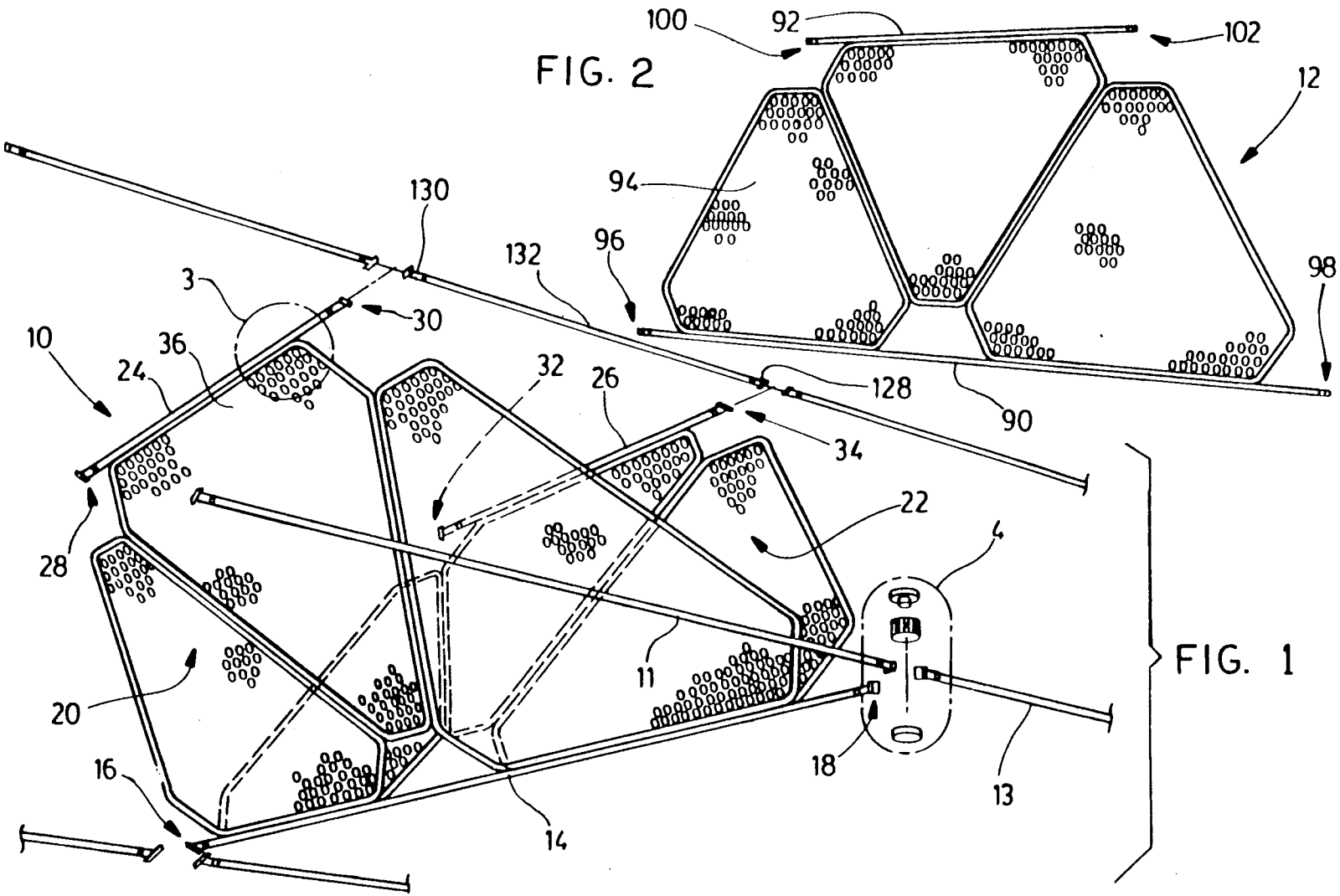
Figure 3:
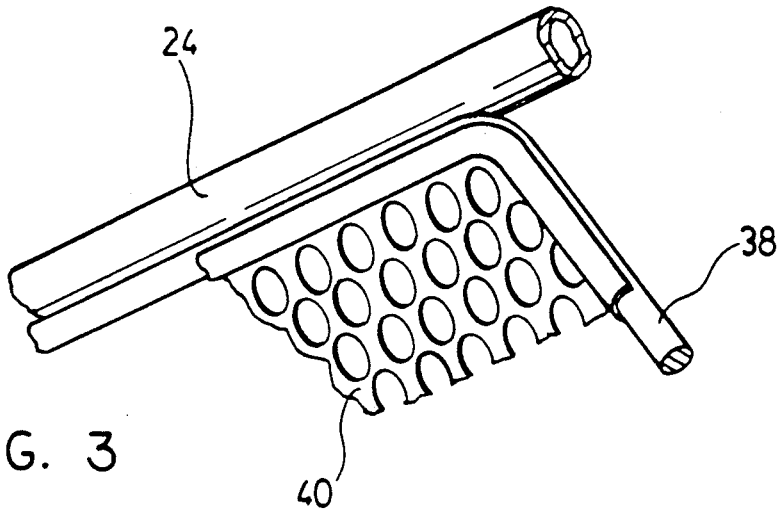
FIG. 3 is a fragmented enlarged perspective view of a portion 3 of FIG. 1 further detailing the construction of the component of FIG. 1.
Figure 8:
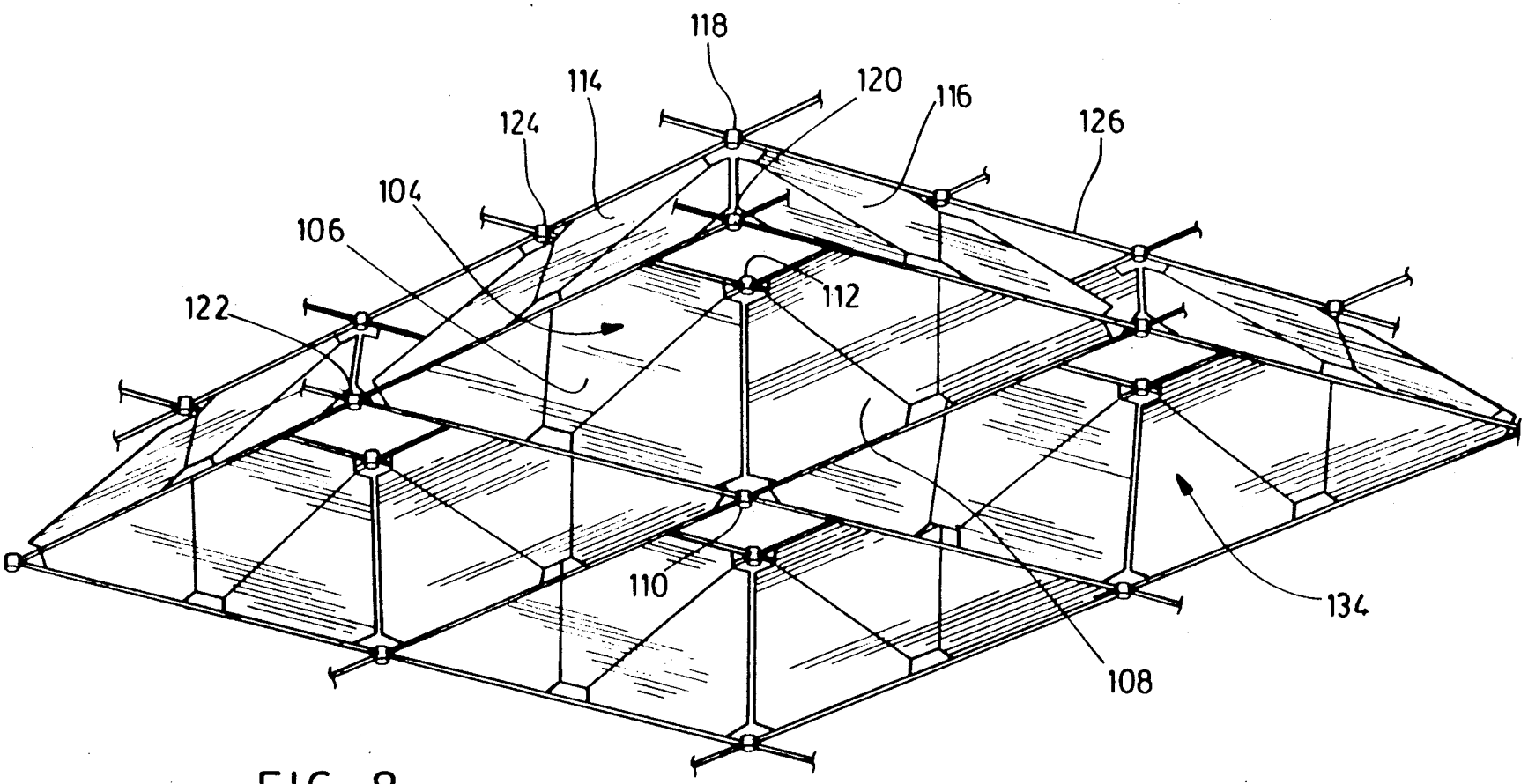
FIG. 8 is a perspective view from below and to one side of a ceiling structure constructed from components similar to those of FIGS. 1 and 2; and, FIG. 9 is a plan view of another ceiling structures which can be assembled from components similar to the component of FIG. 2.

FIGS. 1 and 2 illustrate two principal components 10, 12 of a kit for constructing cellular display structures. The component 10 of FIG. 1 is generally V-shaped in end view, while the component 12 of FIG. 2 has a generally planar configuration. A typical ceiling structure which might be formed from such components is illustrated in FIG. 8. V-shaped components would typically be used to create the interior region of the ceiling, while the planar components may be used to appropriately terminate outer side surfaces of the ceiling structure. As discussed more fully below, a kit incorporating only the planar components and appropriate connectors may be used to assemble complex structure with unusual geometries.

The V-shaped component 10 is detailed in FIGS. 1, 3, 5–7. In FIG. 1, the V-shaped component 10 has been illustrated proximate to two rods 11, 13. These rods 11, 13 are in fact base rods of two V-shaped components identical to the component 10, but the remaining structure associated with such components has been omitted in order to highlight the manner in which the component 10 would joined with other display structure at various vertices associated with the component 10. The spatial relationship between the V-shaped component and those whose detail has been omitted can be understood by examining the ceiling structure of FIG. 8.

The V-shaped component 10 includes a tubular steel base rod 14 whose opposing ends define two opposing base vertices. A pair of substantially identical planar metal panels 20, 22 constitute side portions of the component 10 and define its V-shape when viewed along the base rod 14 as in FIG. 7. Two tubular steel rods 24, 26 define peripheral edges of the metal panels 20, 22. Each is attached to the associated panel in parallel relationship to the base rod 14 and with its ends inset at equal distances relative to the opposing ends of base rod 14. The opposite ends of the edge rod 24 define a first pair of opposing edge vertices 28, 30 while the ends of the other edge rod 26 define a second pair of opposing edge vertices 32, 34.

The side panel 20 of the V-shaped component 10 is typical. It is constructed in three generally triangular sections which are joined by welds and which together provide the generally planar, trapezoidal shape of the panel. A portion of one triangular section 36 is illustrated in greater detail in the enlarged fragmented view of FIG. 3 where it may be seen to comprise a wire frame 38 and a perforated metal sheet 40. A circumferential edge portion of the sheet 40 is bent to seat in a conforming fashion with the wire frame 38 and is tack-welded to the wire frame 38 at intervals. The wire frame 38 is itself welded to tubular edge rod 24.

The base vertices 16, 18 and each pair of edge vertices are in trapezoidal vertex relationship. Basically, the base vertices 16, 18 and the first pair of edge vertices 28, 30 are substantially coincident with the vertices of a hypothetical trapezoid having a base, a side parallel to and shorter than the base, and two sides inclined relative to the base which are of equal length. A similar relationship is observed between the base vertices 16, 18 and the other pair of edge vertices 32, 34. This arrangement is significant to the manner in which adjacent components meet for purposes of releasable connection to define, for example, a cellular structure such as that illustrated in FIG. 8, as will become more apparent below.

Figure 7:
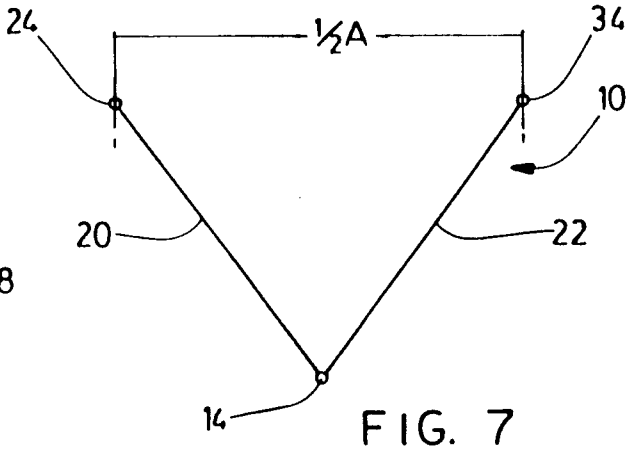
FIGS. 5, 6 and 7 are a plan view from below, a side elevational view and an end view respectively of the component of FIG. 1.
Figure 6:
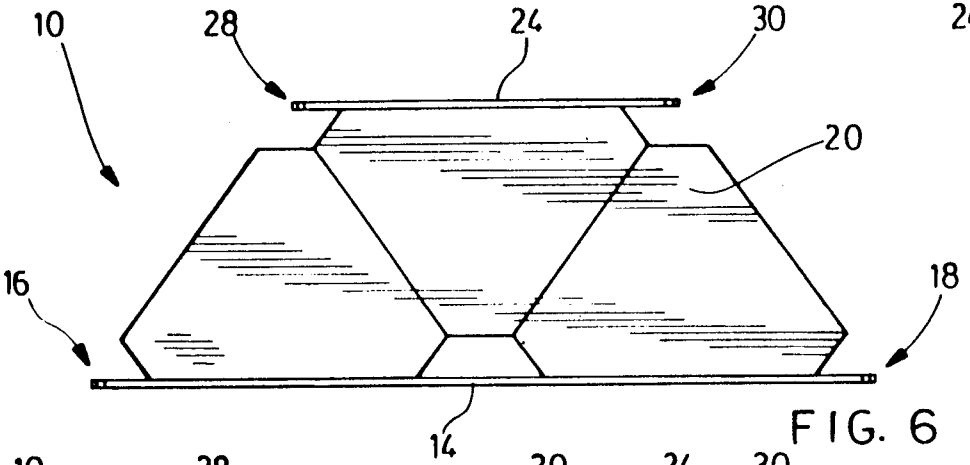
Figure 5:
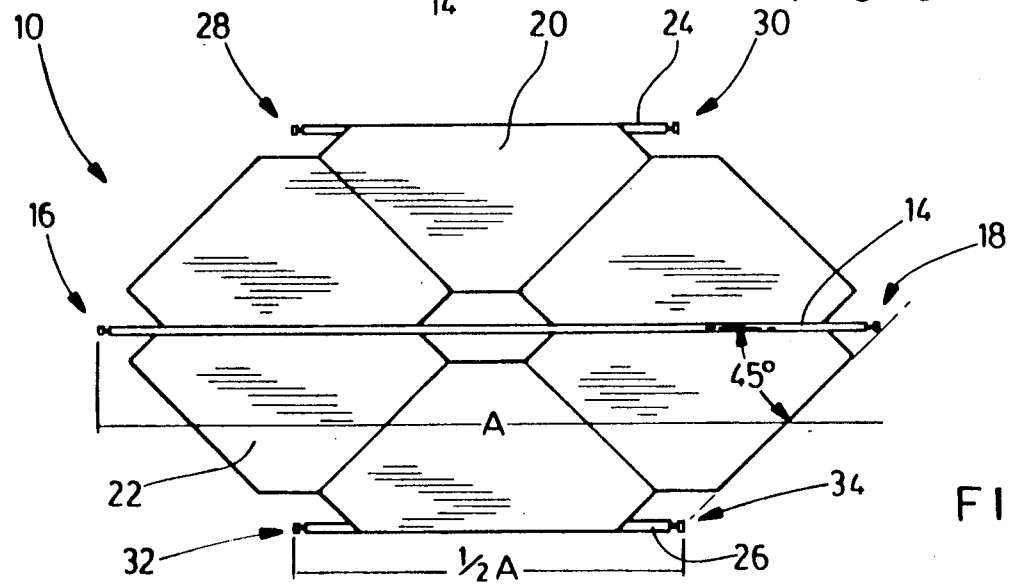

The overall dimensions and geometry of the V-shaped component 10 will be apparent in FIGS. 5-7. The base rod 14 has a length which has been arbitrarily designated in FIG. 5 as A units. Each of the edge rods 24, 26 has a length which is one-half of the length of the base rod 14. As indicated in FIG. 7, the two edge rods 24, 26 are themselves spaced by a distance of ½ A, namely, the common length of the edge rods 24, 26. The four edge vertices are consequently coincident with the corners of a hypothetical square having sides of length ½ A. This arrangement permits connecting rods (described more fully below) intended to reinforce a structure to also have a length of ½ A. Since a kit may consist of V-shaped components, planar components and connecting rods, only two distinct lengths of rod need be cut for production of all kit elements (excluding connectors, of course), and this simplifies manufacture. This ratio of the length of the edge rods to the base rods may be changed for the general purposes of the invention to another predetermined fraction. The angle subtended by the sides panels 20, 22 is nominally 72 degrees, but the angle may be varied and the spacing in the trapezoidal relationship adjusted accordingly to ensure formation of tight corners in a cellular structure. Variation of the angle primarily changes the inclination of the walls of each cell of the structure, affecting the extent to which the cells appear "open" or "closed".

Figure 4:
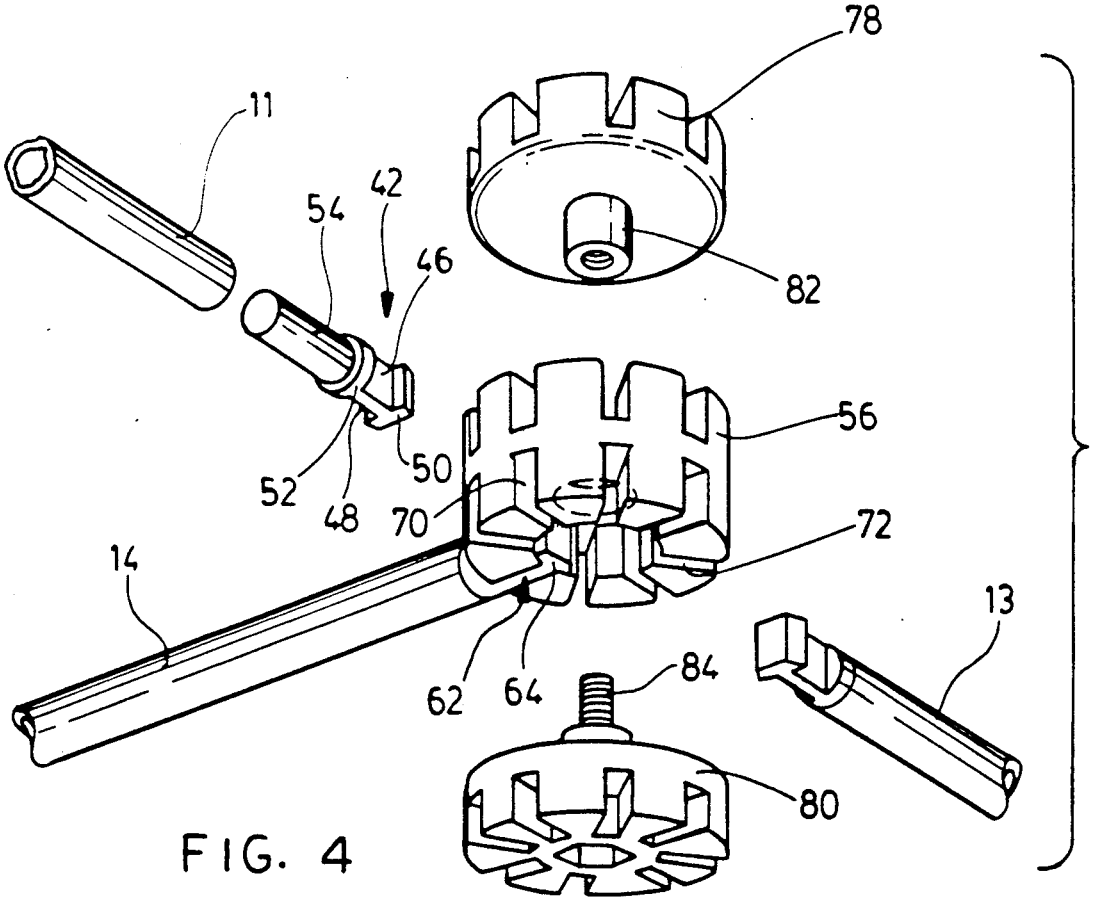
FIG. 4 is an exploded perspective view of a joining arrangement associated with the component.

Each vertex of the V-shaped component 10 is associated with a connector for use in joining the vertex to a proximate vertex of a similar component. The structure of such a connector is best illustrated in FIG. 4 where a connector 42 associated with the base rod 11 of FIG. 1 is shown exploded from the base rod. The connector 42 includes a T-shaped connector portion 44 with parallel side surfaces 46, 48 and a transverse cross-member 50 whose extreme surfaces are beveled. The connector 42 also comprises a cylindrical socket portion 52 into which is fitted a length of solid steel rod 54. The connector 42 would be attached to the base rod 11 by inserting the steel rod 54 into the open end of the base rod and then welding the structure so assembled. Prior to welding, however, the angular orientation of the cross-member 50 relative to the general plane of the component would be set.

The angular relationship which each T-shaped connector associated with a V-shaped component observes will be discussed with reference to the V-shaped component 10 of FIG. 1. The general plane of each T-shaped portion of each connector fixed at the base vertices 16, 18 is oriented perpendicular to the general plane of the V-shaped component 10 (the plane containing the base rod 14 and vertical in the orientation of FIG. 1), forming a nominal angle of about 36 degrees with the general plane of each of the side panels 20, 22. The T-shaped connector portions at the edge vertices 28, 30, 32, 34 are similarly oriented at right angles to the general plane of the V-shaped component. The various T-shaped connector portions consequently form an acute angle relative to each of the side portions 20, 22 which is substantially 90 degrees less one-half of the angle subtended by the side portions 20, 22, and in this case the acute angle is nominally 54 degrees. The latter angular relationship has more significance to the manner in which planar end panels are formed, which will be discussed more fully below. It should be noted that these angular relationships are dictated by the type of connector which is used to join the various V-shaped and planar components of the required structure and may change if alternative connectors are used.

A connector complementary to the T-shaped connectors carried by the V-shaped and planar components is shown exploded in FIG. 4 and generally indicated by the reference numeral 55. The connector 55 includes a generally disk-shaped body portion 56 formed with eight radially-directed lower slots. Each slots is angled at about 45 degrees relative to each adjacent slot. A similar arrangement of upper slots is present to permit upper and lower joints to be formed with a single connector, as in the ceiling structure illustrated in FIG. 11. In FIG. 4, only the lower set of connection slots are used, as might be the case in constructing the ceiling structure of FIG. 8.

A connector 62 positioned at the vertex 18 of the base rod 14 of the V-shaped component 10 has been shown installed into one lower slot of the connector 55. The body portion 56 of the connector 55 acts against the underside of the cross-member 64 associated with the connector 62 to retain the connector 62 against relative radial displacement. The T-shaped connector 42 associated with the base rod 11 and another T-shaped connector 70 associated with the base rod 13 of two adjacent panel can be installed into slots 74, 76, thereby orienting the base rods of the various V-shaped components at right angles and simultaneously orienting the panels associated with these components to form proper corners.

The complementary connector 55 includes two cap members 78, 80 which ensure that the T-shaped connectors associated with the base rods are positively retained. One cap member 78 has a central cylindrical sleeve 82 with an internal screw thread while the other cap member 80 has a central screw 84 which can be extended through a clearance hole (not illustrated) in the connector body portion 56 towards the threaded sleeve 82. With the two cap members 78, 80 positioned over opposing faces of the connector body portion 56, and fastened together, any T-shaped connector portions installed into the slots of the body portion 56 is securely retained. The beveling of the extreme surfaces of each the cross-member associated with each T-shaped connector permits the connector body portion 56 to be radially compact and still accommodate up to eight T-shaped connectors.

The particular connectors in this arrangement are conventional. However, the angular orientation of the T-shaped connectors relative to the general plane of the V-shaped components and the effect of such an arrangement on assembly of components is not a matter which the prior art has had to address. The present arrangement has the significant advantage that the angular orientation of the T-shaped connectors of each component relative to its general plane constrains workmen to join the components in a predetermined relative orientation (as, for example, the orientations shown in FIG. 8) and facilitates the production of a desired structure. Other connectors can, however, be substituted for purposes of the invention.

The planar component 12 is similar in general construction to the component 10. As apparent in FIG. 2, the component 12 comprises a base rod 90 and a parallel edge rod 92. A three-section panel 94 of generally trapezoidal peripheral shape joins the base and edge rods 90, 92. The component 12 comprises four vertices: a first pair of vertices 96, 98 defined by opposing ends of base rod 90, and a second pair 100, 102 defined by opposing ends of edge rod 92. The four vertices are oriented in trapezoidal vertex relationship, as described above. Each of the vertices is associated with a T-shaped connector. For purposes of using the planar component 12 as an end panel for the ceiling structure of FIG. 8, each of the T-shaped connectors would bear the same angular relationship relative to the general plane of the component 12 as corresponding base and edge connectors of the V-shaped component 10 bear relative to each side panel 20, 22; that is, each of the T-shaped portion is inclined relative to the general plane of the component 12 by an acute angle substantially equal to 90 degrees less one-half the angle subtended by the side portions 20, 22 of the typical V-shaped component 10, namely, 54 degrees (nominally). An alternative manner of viewing this arrangement is that the general plane of each T-shaped connector associated with the planar component 12 forms an acute angle relative to the general plane of the component which is substantially about 90 degrees minus the predetermined angle of inclination which the planar component is ultimately intended to assume relative to vertical. The angle of inclination is the angle which the planar component might be required to assume when used as an end panel in a cellular structure such as that of FIG. 8 or when used exclusively with similar planar panels to constitute a more complex cellular structure.

A typical ceiling structure constructed from a kit of components such as components 10, 12, a multiplicity of connectors such as the connector 55 (as illustrated in FIG. 4), and reinforcing rods, is illustrated in FIG. 8. The ceiling structure has four distinct cells all formed in a similar manner. The cell 104 which is typical comprises two V-shaped components 106, 108 whose base rods are perpendicular to one another. The proximate vertices of the two V-shaped components 106, 108 are joined with connectors 110, 112 in the manner described above. Two planar end components 118, 120 complete the exterior surfaces of the cell. The planar components 118, 120 are oriented at right angles to themselves and to each immediately adjacent one of the V-shaped components 106, 108. The proximate vertices of the two planar components 118, 120 are joined with similar type connectors 122, 124. Similar connectors 122, 124 join the planar end panel 118 to V-shaped panel 106. Reinforcing or connecting rods such as the rod 126 join adjacent upper ends of the cells A typical reinforcing rod 128 is best illustrated in FIG. 1 where it may be seen to comprise T-shaped connectors 130, 132 at either end by means of which the reinforcing rods can be joined between the upper connectors otherwise holding the various cells.

It should be noted that V-shaped component of the cell 104 defines not only one wall of that cell, but also constitutes one wall of the adjoining cell 134. In the particular structure illustrated in FIG. 8, each cell in fact shares two of its V-shaped components with each adjoining cells. In a similar structure, but with greater extent, each inner cell would typically share each of its four V-shaped components with each of the four adjoining cells. This arrangement provides the resultant structure with an inherent rigidity and stability even absent the use of reinforcing rods.

It will be apparent that the generally trapezoidal shape of the side portions of each V-shaped and planar component together with the relative angle of the connectors associated with their vertices lead naturally and easily to the construction of cell structures of the geometry illustrated. Even relatively inexperienced staff can readily visualize the manner in which a required structure is to be progressively assembled. Such assembly may be done at a ground level and the resultant structure then lifted to the required location. Alternatively, to accommodate support structure such as beams or vertical panels, the ceiling might be partially assembled, rested on the supporting structure and the remaining cells completed to ensure that the structure rests properly on the supports provided.

Structure analogous to that of FIG. 8 might be constructed solely from planar components. However, in structures where the components generally at right angles (disregarding panel inclination), the V-shaped components are strongly preferred. If a large expanse of ceiling space is to be covered, the V-shaped components produce an inherently more rigid and stable structure by virtue of the sharing of components between adjacent cells. Also, installation of a V-shaped component into a particular cell immediately defines one wall of an adjacent cell. The entire structure can consequently be assembled in less time. In either case, however, a desired structures can be assembled much more quickly and in a more predictable manner than with convention wire space frames.

Figure 9:
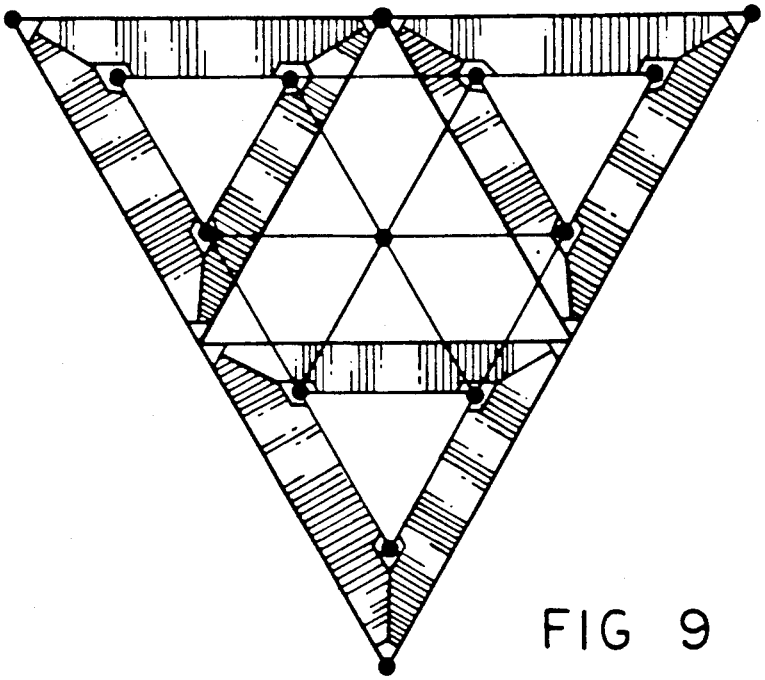
Figure 11:
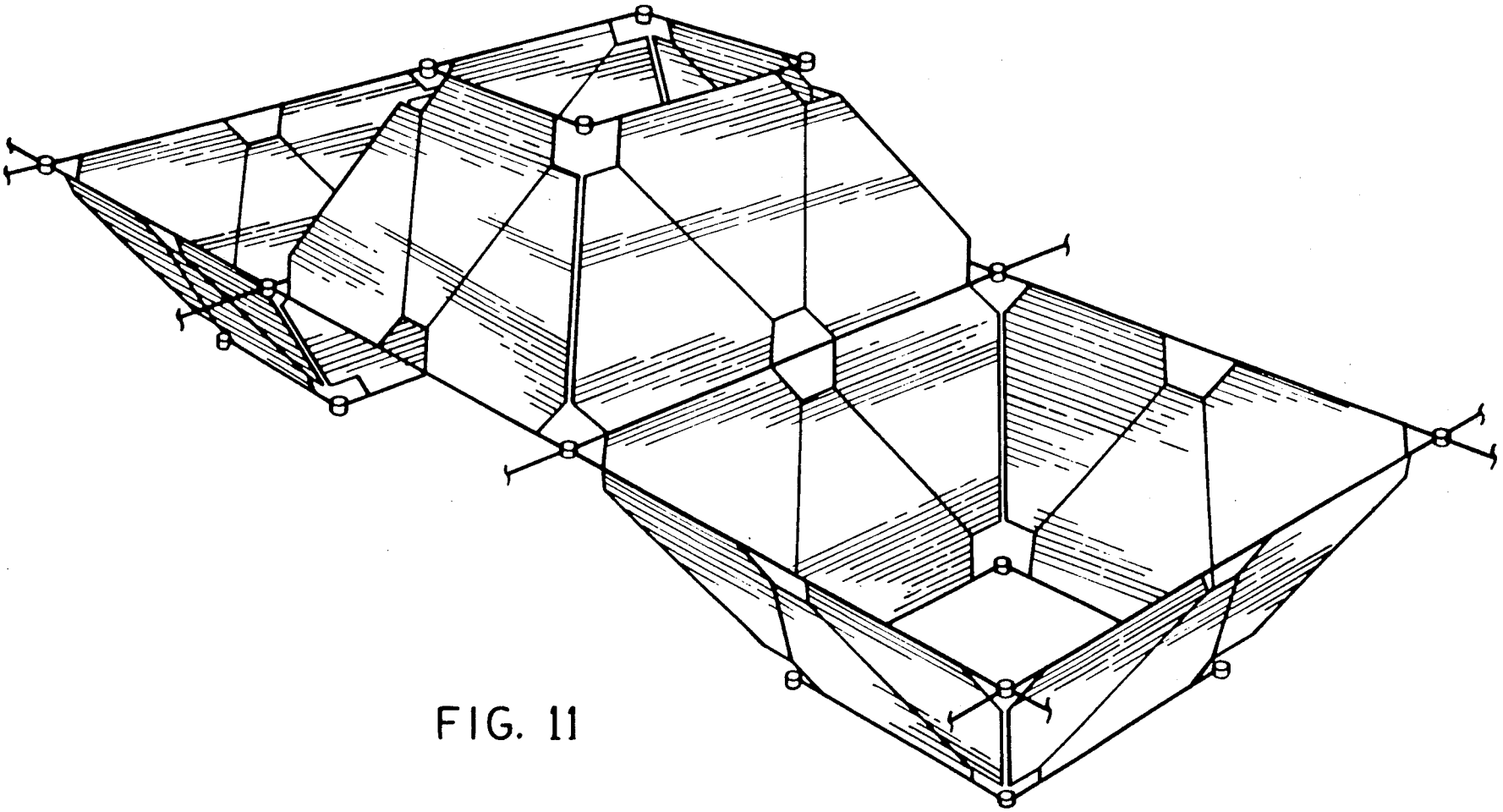
FIG. 11 is a perspective view of still another ceiling structure which can be assembled from components similar to the component of FIG. 2.

FIG. 9 and 11 illustrates more complicated structures which can be assembled from kits comprising only planar components, a multiplicity of connectors and optionally reinforcing rods.

Figure 10:
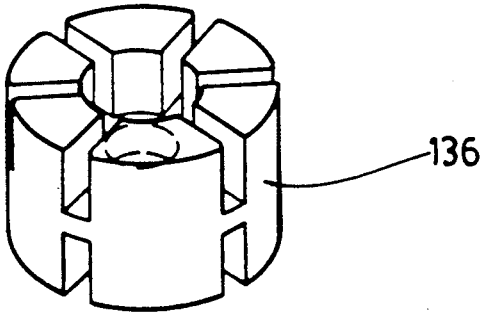
FIG. 10 is a perspective view of a portion of a connector appropriate for use in assembling the structure of FIG. 9.

FIG. 9, the outer corners of the structure illustrated are angled at about 60 degrees and an overall triangular configuration is achieved. The disk-shaped body portion 136 of a connector appropriate for joining components of the kit to produce such a structure is illustrated in FIG. 10. Each radial slot associsated with the connector body protion 136 is angled at 60 degrees ralative to adjacent slots thereby permitting the planar components to be joined at angles of 60 and 120 degrees. The angle of the T-shaped connectors terminating the base and edge rods of each component ralative to the general plane of each component would be selected to ensure that the side edges of the generally trapezoidal components meet sufficiently to permit simultaneous installation of the T-shaped connectors inito the disk-shaped connectors and to form apporopriate corners. The lenght of the associated reinforcing rods would be similarly adjusted to accommodate the shape of the display structure to be produced.

The ceiling structure of FIG. 11 can be erected from planar components of the type illustrated iin FIG. 2 using connectors such as the connector 55 of illustrated in FIG. 4. It will be apparent that such components lend themselves to the production of a wide range of display structures.

Although the components of the invention have been discussed in connection withceiling structures, they also lend themselves to the construction of walls of cellular design. Such wall and ceiling structures might even be joined to provide a self-supporting structure. To that end, special connectors can be provided which comprise essentially two cylindrical slotted connectors such as the connector 55 of FIG. 4, mounted at opposing ends of a right-angled bracket. These can then be used to couple vertices of the end components of the ceiling structure with the vertices associated with the upper components of a vertically-oriented wall structure.

Figure 12:
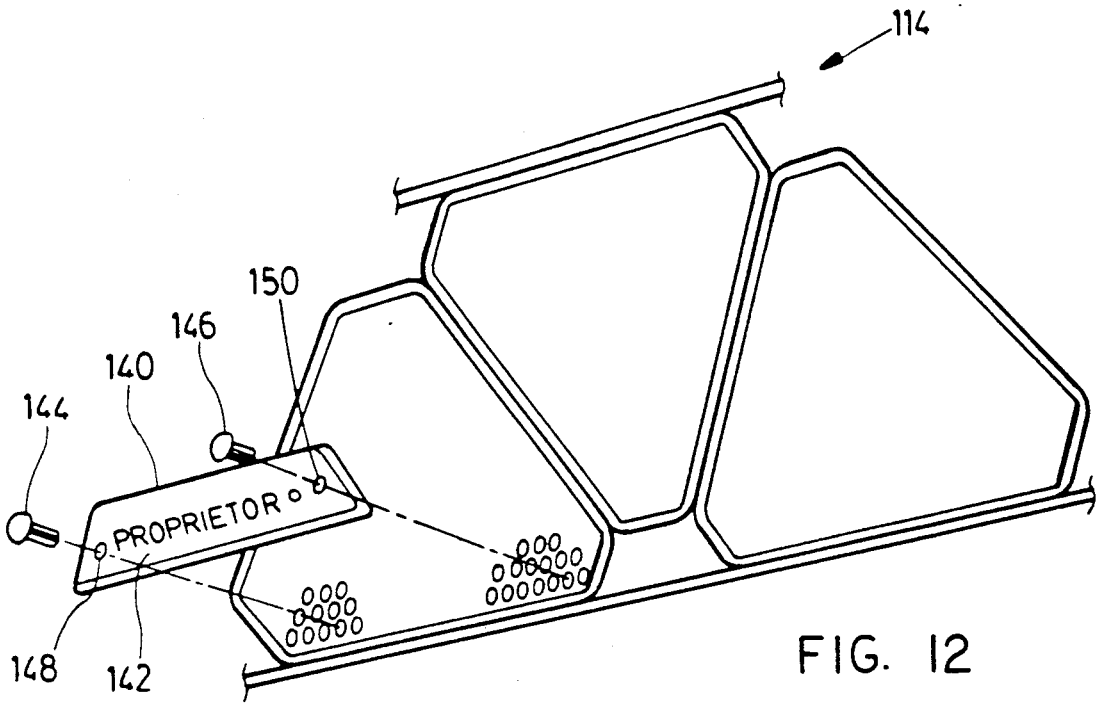
FIG. 12 and 13 are cross-sectional view and an exploded perspective view illustrating how a sign bearing an inscription can be attached to a planar component constituting an end panel of the structure of FIG. 8.
Figure 13:
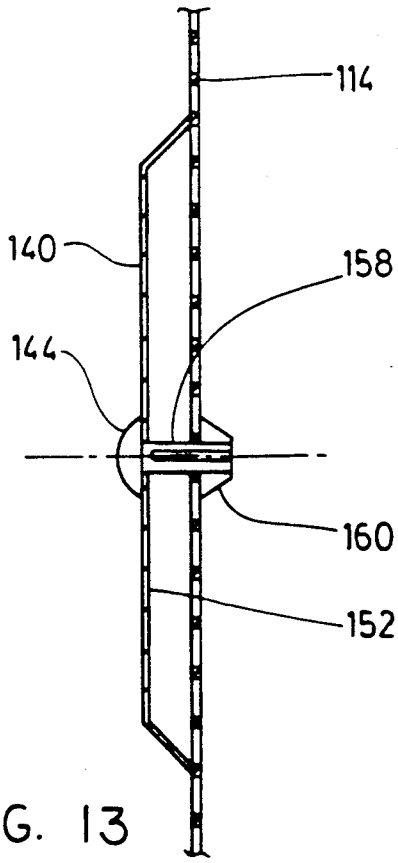

In connection with display structure, it is generally desirable to provide some means for displaying proprietor identification, advertising material or the like. Another aspect of the invention relates to the manner in which signs can be attached to the V-shaped or planar components provided by the invention. FIG. 12 and 13 illustrate the planar end component 114 of the structure of FIG. 8. The planar component 114 is formed with a multiplicity of regularly spaced apertures of a predetermined uniform size. A metal suppor member 140 is cut and bent ot a desired shaped and a forward surface 142 bears the indicia to be drawn to the attention of individuals who observe the associated cellular display structure. A pair of fasteners 144, 146 fit through two spaced-apart openings 148, 150 formed in the support member 140 so that they extend rearwardly of the rear surface 152 of the support member 140. The fasteners 144, 146 and dimensioned to fit into any one of the apertures associated with the structural component 114, and the separation of the opeings 148, 150 in the support membner 140 and consequently the spacing of the fasteners 144, 146 are such that the fasteners 144, 146 can be simultaneously located into different apertures of the component 114, as for example, into the apertures 154, 156.

The fastener 144 which is typical has a plastic shaft 158 and abutment head 160 which are split longitudinally into two elastically movable parts the abutment head 160 is beveled to facilitate introduction into the apertures from one side of the planar component 114, the two components of the head 160 drawing together durinig insertion, and then separating when located on an opposing side of the planar component 114 to anchor the support member 140. A key featurre of this aspect of the invention is the provision of the regularly spaced apertures in a structural component and the relative separation of the fasteners which permit an indicia support member to be attached at essentially any convenient position relative to the structural component. The support member 140 can, of course, be attached in a similar manner to any one of the V-shaped components to display materials in the interior of a display structure, the side portions associated with each of the V-shape components also being formed with a multiplicity of regularly space apertures of uniform size.

It will be appreciated that particular embodiments of the invention have been describned for purposes of illustrating the principles inherent in the inivention and that modifications may be made therein without departing from the spirit of the invention and without necessarily departing from the scope of the appended claims.

We claim:

1. A component adapted to be joined with substantially identical components to form a knock-down cellular structure, comprising:

an elongate base portion having an axis and a pair of opposing base vertices spaced-apart along the axis;

first and second side portions rigidly fixed to and extending away from the portion, the first side portion defining a first pair of opposing spaced-apart edge vertices and the second side portion defining a second pair of opposing spaced-apart edge vertices, the first pair of edge vertices defining with the base vertices a first set of vertices in a trapezoidal vertex relationship, the second pair of edge vertices defining with the base vertices a second set of vertices in a trapezoidal vertex relationship substantially identical to the trapezoidal vertex relationship of the first set of vertices, the first and second side portions together having a generally V-shaped cross-section with a fixed predetermined angle between general planes of the first and second side portions when viewed along the axis of the base portion;

each vertex of the component comprising a connector portion for use in releasably securing the vertex of the component to a proximate vertex of a substantially identical component;

the vertices of each set being so spaced relative to one another and the fixed angle being so selected that one of the pair of base vertices and an adjacent edge vertex of the component are substantially parallel to one of the pair of base vertices and an adjacent edge vertex of a substantially identical component when respective general planes of the component and the substantially identical component are substantially perpendicular.

2. A component as claimed in claim 1 in which the connector portion of each vertex comprises a T-shaped portion oriented at a predetermined angle relative to a general plane of the component containing the axis of the base portion.

3. A component as claimed in claim 2 in which each T-shaped portion has its general plane oriented substantially perpendicular to the general plane of the component.

4. A component as claimed in claim 1 comprising:

a base rod defining the base portion and having opposing end portions which define the base vertices;

first and second edge rods substantially parallel to the base rod, the first edge rod defining the first pair of edge vertices, the second edge rod defining the second pair of edge vertices;

a first panel of generally trapezoidal shape extending between the first edge rod and the base rod; and, a second panel of generally trapezoidal shape extending between the second edge rod and the base rod.

5. A component as claimed in claim 4 in which the length of each edge rod is substantially one-half the length of the base rod and in which the perpendicular distance between the first and second edge rods is equal to about one-half the length of the base rod.

6. A component as claimed in claim 4 in which the base rod and each of the edge rods is tubular with a hollow interior and in which the connector portion of each vertex comprises a socket portion to which the T-shaped portion is connected and a connecting rod which has one rod end portion retained in the socket portion and another rod end portion retained in the interior of the one of the base and edge rods defining the vertex comprising the connector portion.

7. A component as claimed in claim 1 in which each of the first and second side portions comprises a multiplicity of regularly-spaced apertures of a uniform size, the componet having means for displaying indicia which comprise:

a support member having a forward surface bearing the indicia and a rear surface;

a plurality of fasteners attached to the support member and extending rearwardly of the rear surface, each of the fasteners being dimensioned to fit into any of the apertures associated with the components, the fasteners being spaced apart relative to one another such that the fasteners can be simultaneously located in the apertures associated with either of the first and second side portions.

8. A component as claimed in claim 7 in which each of the fasteners comprises an abutment portion adapted to contract during insertion through any one of the apertures and thereafter to expand to obstruct withdrawal through the aperature.

9. A kit for constructing a knock-down cellular structure comprising:

a multiplicity of substantially identical components, each component comprising a. an elongate base portion having an axis and a pair of opposing base vertices spaced-apart along the axis, and b. first and second side portions rigidly fixed to and extending away from the base portion, the first side portion defining a first pair of opposing spaced-apart edge vertices and the second side portion defining a second pair of opposing spaced-apart edge vertices, the first pair of edge vertices defining with the base vertices a first set of vertices in a trapezoidal vertex relationship, the second pair of edge vertics defining with the base vertices a second set of vertices in a trapezoidal vertex relationship substantially identical to the trapezoidal vertex relationship of the first set of vertices, the first and second side portions together having a generally V-shaped cross-section with a fixed predetermined angle between general planes of the first and second side portions when viewed along the axis of the base portion, the vertices of each set being so spaced relative to one another and the fixed angle being so selected that one of the pair of base vertices and an adjacent edge vertex of the component are substantially parallel to one of the pair of base vertices and an adjacent edge vertex of a substantially identical component when respective general planes of the component and the substantially identical component are substantially perpendicular, c. each vertex of the component comprising a connector portion for usr ini releasably securing the vertex of the component to a proximate vertex of a substantially identical component;

a multiplicity of connection means cooperating with the connector portions of the components to releasably join proximate vertices of the components at least when each one of the components is oriented with the axis of its base portion substantially perpendicular to the axis of the base portion of any other of the components that is located proximate to either of the base vertices of the one component.

10. A kit as claimed in claim 9 including a multiplicity of substantially identical generally planar components, each of the planar components having a set of four vertices in a trapezoidal vertex relationship substantially identical to the trapezoidal vertex relationship of the first set of vertices of each V-shaped components, each vertex of each planar component comprising a connector portion cooperating with any one of the multiplicity of connection means to releasably secure the vertex to the proximate vertex of an adjacent component.

11. A kit as claimed in claim 10 in which each vertex of each of the V-shaped and planar components comprises a T-shaped portion co-operating with any one of the multiplicity of connection means to releasably secure the vertex at which the T-shaped portion is located to a proximate vertex of another of the components.

12. A kit as claimed in claim 11 in which:

the T-shaped portion associated with each vertex of each V-shaped component has a general plane oriented substantially perpendicular to a general plane of the associated V-shaped component containing the axis of the base portion of the associated V-shape component;

the T-shaped portion associated with each vertex of each planar component has a general plane oriented at an acute angle relative to the general plane of the associated planar component, the acute angle being about 90 degress less one-half the angle between the first and second side portions of each of the V-shaped components; and, each of the connection means has a body portion formed with a multiplicity of radially-directed slots shaped to receive any one of the T-shaped portions.

13. A kit as claimed in claim 10 in which each of the V-shaped components comprises:

a base rod defining the base portion and having opposing end portions which define the base vertices;

first and second edge rods substantially parallel to the base rod, the first edge rod defining the first pair of edge vertices, the second edge rod defining the second pair of edge vertices;

a first panel of generally trapezoidal shape extending between the first edge rod and the base rod; and, a second panel of generally trapezoidal shape extending between the second edge rod and the base rod.

14. A kit as claimed in claim 13 in which each of the planar components comprises:

a first rod having end portions defining a first pair of the four vertices of the planar component;

a second rod substantially parallel to the first rod and having end portions defining a second pair of the four vertices of the planar component; and, a panel of generally trapezoidal shape extending between the first and second rods.

15. A knock-down cellular structure comprising:

a multiplicity of substantially identical components, each component comprising a. an elongate base portion having an axis and a pair of opposing base vertices spaced-apart along the axis, and b. first and second side portions rigidly fixed to and extending away form the base portion, the first sife portion defining a first pair of opposing spaced-apart edge vertices and the second side portion defining a seond paijr of opposing spaced-apart edge vertices, the first pair of edge vertices defining with the base vertices a first set of vertices in a trapezoidal vertex relationship, the seconde pair of edge vertices defining with the base vertices a second set of vertices in a trapezoidal vertex relationship substantially identical to the trapezoidal vertex relationship of the first set of vertices, the first and second side portioins together having a generally V-shaped cross-section with fixed predetermined angle between general planes of the first and second sife portions when viewed along the axis of the base portion, the vertices of each set being so spaced relative to one another and the fixed angle being so selected that one of the pair of base vertices and an adjacent edge vertex of the component are substantially parallel to one to the pair of base vertices and an adjacent edge verted of a substantially identical component when respective general planes of the component and the substantially identical component are substantially perpendicular:

a multiplicity of coninection means releasably joining adjacent vertices of the components to define a multiplicity of cells, the components being oriented relativce to one another such that each of the multiplicity of cell has a first inclined wall defined by one of the side portions of a first of the components and a second inclined wall defined by one of the side portions of a second of the components, the other of the side portions of the first component defining an inclined wall associated with a first adjoining cell, the other of the side portions of the second component defining an inclined wall associated with a second adjoining cell.

16. A cellular structure as claimed in claim 15 in which the connection means comprise:

a T-shaped connector portion at each vertex of each of the multiplicity of components;

a multiplicity of complementary connectors, each of the complementary connectors having a body portion formed with a multiplicity of radiallly-directed slots wshaped to receie any one of the T-shaped connector portions.

17. A cellular structure as claimed in claim 15 comprising a multiplicity of substantially identical, generally planar components releasably connected by the multiplicity of connectin means to the V-shaped components and definiing inclined outer peripheral surfaces of the structure, each of the planar components having four vertices in a trapezoidal vertex relationship substantially identical to the trapezoidal vertexd relationship of each of the sets of vertices of the V-shaped components, the multiplicity of connection means releasably joining vertices of each planar component to proximate vertices of others of the V-shaoped and planar components.

18. A cellular structure as claimed in claim 17 in which the multiplicity of connection means comprise:

a T-shaped portion at each vertex of each V-shaped component aknd having a general plane oriented substantially perpendicular to a general plane of the associated V-shaped component containing the axis of the base portion of the associated V-shape component;

a T-shaped portion at each vertex of each planar component and having a general plane oriented at an acute angle relative to the general plane of the associated planaor component, the acute angel being about 90 degrees less one-half of the angle between the first and second side portions of each of the V-shaped components; and, a multiplicity of connectors each having a body portion formed with a multiplicity of radially-directed slots shaped to receive any one of the T-shaped portions.

19. A cellular structure as claimed in claim 17 in which at least one of the V-shaped and planar components is formed with a multiplicity of regularly-spaced apertures of uniform size, the cellular structure including means for displaying indicia comprising:

a support member having a forware surface bearing the indicia and a rear surface;

a plurality of fasteners attached to the support member and extending rearwardly of the rear surface, each of the fasteners being dimensioned to fit into any one of the apertures associated with the at least one of the components, the fasteners being spaced apart relative to one another such that the plurality of fasteners are simultaneously located in the apertures associated with the at least one of the components.

20. A cellular structure as claimed in claim 19 in which each of the fasteners comprises an abutment portion adapted to contract during insertion through any one of the apertures and thereafter to expand to obstruct withdrawal through the aperture.

21. A knock-down cellular structure comprising:

a multiplicity of substantially identical planar components;

each of the planar components having a general trapezoidal peripheral shape, a pair of opposing side edges inclined ralative to one another, a set of four vertices in trapezoidal vertex relationship, and a connector portion at each of the set of four vertices;

a multiplicity of substantially identical connectors cooperating with the connector portions of the planar components to releasably join adjacent vertices of the components to define a multiplicity of cells;

each cell comprising an upper opening, a lower opening and a sidewall extending between the upper and lower openings, the sidewall being defined by at least three of the multiplicity of planar components each inclined trlative to vertical, each of the planar components that defiine the sidewall having each of its opposing inclined side edges oriented substantially parallel and proximate to one on the side edges of each of two others of the planar components that define the sidewall, at least one of the planar components that define the sidewall of trhe cell also defining part of a sidewall of an adjoining cell.

22. A cellular structure as claimed in claim 21 in which:

each of the connector portions of each planar component comprises a T-shaped portion;

each of the multiplicity of connectors comprises a body portion formed with a multiplicity of radially-directed slots shaped to receive any one of the T-shaped portions of any one of the planar components.

23. A cellular structure as claimed in claim 22 in which the planar components are oriented at a predetermined angle of inclination relative to vertical and in which each T-shaped portion of each component has a general plane inclined relative to the general plane of the component at an angle of about 90 degrees minus the predetermined angle of inclination.

* * * * *